United States Patent [19]

Hoover

[11] 4,377,925

[45] Mar. 29, 1983

[54] BRACKET FOR CONDUIT TRENCHES

[75] Inventor: Robert A. Hoover, Clearwater, Fla.

[73] Assignee: Able, Inc., St. Petersburg, Fla.

[21] Appl. No.: 239,401

[22] Filed: Mar. 21, 1981

[51] Int. Cl.[3] ..... E02D 00/00

[52] U.S. Cl. ..... 52/169.1; 52/220; 52/696; 138/105

[58] Field of Search ..... 52/169.1, 169.6, 169.9, 52/169.13, 220, 281, 241, 243, 696; 138/105; 405/217, 272, 282; 174/68 C

[56] References Cited

U.S. PATENT DOCUMENTS

| | | | |
|---|---|---|---|
| 1,805,435 | 5/1931 | Amsden | 405/217 |
| 2,138,291 | 11/1938 | Callaghan | 52/243 |
| 2,321,671 | 6/1943 | Grotta | 52/243 |
| 2,368,620 | 2/1945 | Strum | 52/243 |
| 2,862,367 | 12/1958 | Silverstein et al. | 52/169.6 |
| 3,313,321 | 4/1967 | Keller | 138/105 |
| 3,568,455 | 8/1971 | McLaughlin et al. | 138/105 |
| 3,598,349 | 8/1971 | Drabe | 174/68 C |
| 4,263,762 | 4/1981 | Reed | 52/169.1 |

*Primary Examiner*—Peter M. Caun

*Attorney, Agent, or Firm*—Walter J. Monacelli

[57] ABSTRACT

The bracket described herein comprises a device for supporting and holding the sidewall of a conduit trench. These conduit trenches are designed to lie on the ground or may be submerged with the top at ground level. Pipe, conduit, electrical cables, etc. may be laid in the trench with the sidewalls held in place by this new bracket. The bracket comprises two angle irons spaced parallel to each other and fastened to each other by crosspieces at the ends thereof. The angle irons have slots or grooves at each end thereof into which the flat base of a vertical member may be inserted. The flat piece of this base is inserted into the pair of slots or grooves to the end of the angle irons where the crosspiece will stop the movement of the vertical piece. The crosspiece serves as a base for the retaining wall and the vertical piece of the bracket holds the wall in a vertical position.

3 Claims, 5 Drawing Figures

BRACKET FOR CONDUIT TRENCHES

BACKGROUND OF THE INVENTION

1. Field of the Invention

This invention relates to a bracket designed to support and to hold in a vertical position the sidewall of a trench used for laying pipe, conduit, electrical cable, etc. More specifically, this bracket comprises a three-piece unit which may be assembled to perform its supporting function. Still more specifically, this bracket comprises a base element and two vertical side elements which are fitted into and firmly held in a vertical position by the base element.

2. State of the Prior Art

Trenches for the described purpose are used presently such as described in U.S. Pat. No. 2,862,367. These comprise, in some cases, concrete slabs having dimensions of about 2"×12"×5' which are supported on precast concrete brackets which have a horizontal base and a vertical portion extending upward at a point about 3" from the end of the base. Two of these brackets are positioned with the horizontal bases abutting each other and the vertical portions in the furthest position from each other so that the aforementioned 3" portion of each bracket is in a position to support abutting, adjacent ends of two of the concrete slabs. These slabs serve as the sidewalls of the trench.

These precast concrete brackets are difficult to cast, heavy and difficult to transport and because of the 90° angle in these brackets, there is considerable breakage even when steel reinforced.

Prior to the above type of trenches, cast iron linings were used such as shown in U.S. Pat. No. 1,805,435. These are obviously much more expensive.

Welded steel brackets have also been used in which horizontal and vertical channel steel pieces have been welded together to form one unit used for supporting the precast concrete sidewalls of a channel. These are awkward and heavy to transport.

SUMMARY OF THE INVENTION

In accordance with the present invention, a bracket has been designed which may be assembled of three individual elements which together are much lighter and more easily transportable than the brackets previously used. This new bracket has a base element comprising two arms, preferably of angle iron, which arms have a length corresponding approximately to the outside width of the desired trench, that is including the concrete slabs which are to form the sidewalls of the trench. These two arms are positioned parallel to each other and fastened to each other at each end thereof by a crosspiece which will eventually serve as a support for the abutting ends of two adjacent concrete slabs. A slot or groove is provided on the sides of the angle irons which face each other which slots or grooves extend under the said crosspieces. The other two elements are vertical elements and are similar in design with each comprising a flat base piece and a vertical piece extending upward at a 90° angle to the base piece. The size and configuration of the flat base piece is designed so that when properly aligned with the said grooves or slots in the arms of the base element the base piece of the vertical element may be slid in the groove or slot to a position where at least a portion of the base piece is positioned under the said crosspiece and is advantageously prevented by the crosspiece from sliding further in that direction. The lower end of the vertical piece of the vertical element is fixed rigidly to the base piece by welding, riveting, bolting, etc. and may comprise advantageously two angle irons parallel and spaced from each other and held in position by two crosspieces, one at each end of the respective ends of these angle irons. The lower ends of the angle irons and the adjacent edge of the lower crosspiece are fastened to the base piece by any suitable means such as welding, etc.

The three elements are assembled into the bracket by sliding one of the vertical elements into the grooves or slots at each end of the base element. This provides a vertical element at each end of the base element so that a concrete slab is supported at each end of the base element. On each crosspiece of the base element there may be supported two abutting ends of two adjacent concrete slabs.

The novel design of this invention may be illustrated by reference to the accompanying drawings in which.

Figure 1:
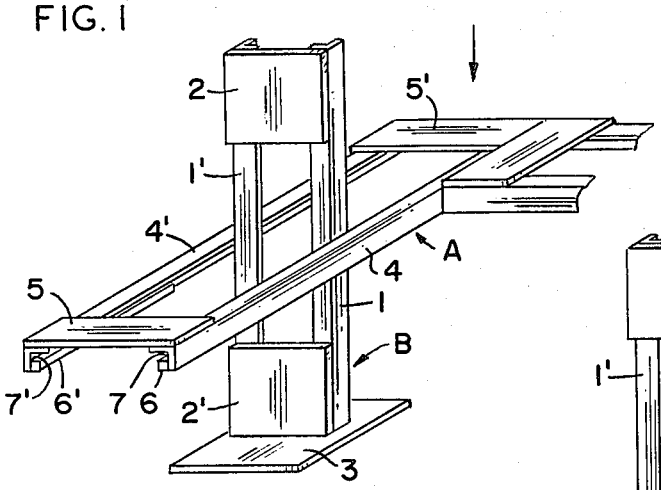
FIG. 1 is a perspective view of the base element and a vertical element of a preferred modification of this invention in which the base element is being lowered so that the flat base piece of the vertical element will be in an position with grooves of the base element.
Figure 2:
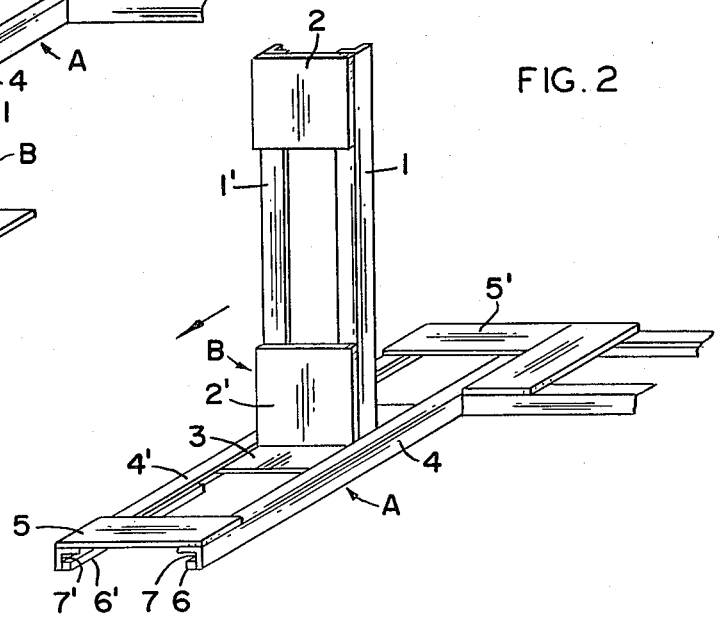
FIG. 2 is another perspective view of the elements shown in FIG. 1 in which the base piece of the vertical element is aligned with the grooves of the base element.
Figure 3:
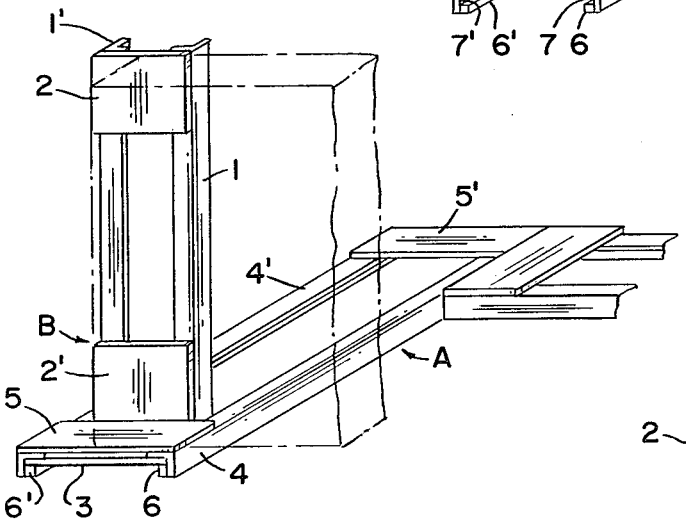
FIG. 3 is another perspective view of the elements shown in FIGS. 1 and 2 in which the base piece of the base element of the vertical element has been slid in the grooves of the base element to its extreme position in that direction.
Figure 4:
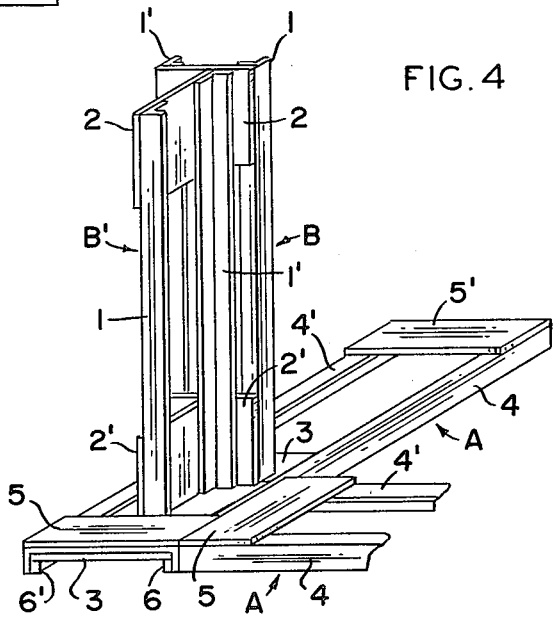
Figure 5:
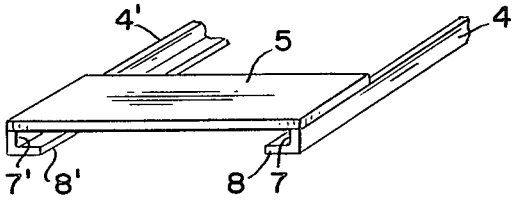

FIG. 4 is a perspective view corresponding to that of FIG. 3 in which a second vertical element has been positioned to show a typical corner condition for a channel in which two concrete slabs are to be held at a right angle to each other; and FIG. 5 is a perspective view of an alternative modification in which angle irons are used in an inverted position as compared to FIGS. 1–4, to form the grooves.

DETAILED DESCRIPTION

In the figures, A is the base element and B is one of the vertical elements. Vertical element B comprises two vertical arms 1 and 1' fastened to each other by crosspieces 2 and 2' and rigidly fastened at its lower end and at a 90° angle to base plate 3. Base element B comprises two arms 4 and 4' fastened by crosspieces 5 and 5'. Arms 4 and 4' have rods 6 and 6' welded or otherwise firmly attached to the inside of arms 4 and 4' so as to form grooves 7 and 7'. Grooves are similarly formed at the opposite ends of arms 4 and 4'. Rods 6 and 6' are of limited length so that there is an open space between them and the rods at the opposite ends of arms 4 and 4' so that base 3 may be raised to the interior of arms 4 and 4'.

In FIG. 1, base element A is being lowered with arms 1 and 1' of the vertical element B being positioned inside arms 4 and 4' of base element A. In FIG. 2, the base plate 3 is aligned with grooves 7 and 7' and in FIG. 3, plate 3 has been slid to the opposite ends of these grooves to the extreme position in which crosspiece 2' is in contact with crosspiece 5.

As previously stated, FIG. 4 shows an adaptation suitable for cornering concrete slabs. In this modification, one concrete slab is abutted against vertical element B' and another slab at 90° to the first is abutted against vertical element B. In this case vertical element B′ is turned at a 90° angle to the position shown in FIGS. 1–3 with the corresponding dimension of base plate 3 being appropriate for entering and being held in grooves 7 and 7′. Vertical element B is positioned in a manner similar to that in FIGS. 1–3 except that vertical element B′ has been interposed between vertical element B and crosspiece 5 of base element A.

FIG. 5 shows another modification in which the angle irons forming arms 4 and 4′ are inverted from the positions shown in FIGS. 1–4 with crosspiece 5 welded to the top edge of the angle irons thereby forming grooves between this crosspiece and the bottom edges 8 and 8′ of arms 4 and 4′. Where this arrangement may provide larger grooves than provided in the arrangements of FIGS. 1–4, this may be compensated by providing thicker areas of the base plate 3 which is to be fitted therein or the size of these grooves may be reduced by appropriately sized plates fixed to the bottom of crosspiece 5. It is also contemplated that this arrangement may be inverted with the crosspiece at the bottom and other changes being made accordingly.

While construction of arms 1, 1′, 4 and 4′ is preferably made of angle irons both for reasons of strength, advantageous configuration and permitting lighter weight because of the strength advantages, other shapes of arms may be used provided grooves and slots are incorporated to permit the assembling arrangements described herein. For example, arms of U-shaped cross-sectional configuration may be used, by positioning them on one side with the openings of the U-shape facing each other provided a section of the lower lip on at least one side is removed to allow entry of base plate 3. Other configurations which are capable of performing the functions described above are also contemplated as suitable for the practice of this invention.

While the above invention has been described for the holding of precast concrete slabs, it is also contemplated that slabs of other materials may be used, such as wood, steel, plastic and other materials.

In the drawings the vertical element B is shown with base plate 3 as a flat plate. However, this base may have other shapes so long as it has two flat parallel edges that can be fitted into the grooves 7 and 7′ of the base element A.

In prior art brackets used for similar purposes, for comparable sizes the concrete bracket described above weighs 132 pounds and the welded channel steel bracket weighs 90 pounds whereas the three-piece bracket of this invention weighs 21 pounds. Moreover, as pointed out above, the bracket of this invention may be disassembled so as to require much less space for storage and shipment.

While certain features of this invention have been described in detail with respect to various embodiments thereof, it will of course be apparent that other modifications can be made within the spirit and scope of this invention and it is not intended to limit the invention to the exact details shown except insofar as they are defined in the following claims.

The invention claimed is:

1. In a channel construction suitable for laying conduit, pipe and electrical cable on or below-ground level wherein slabs are provided as sidewalls with a bracket adapted to hold said sidewall slabs, the improvement in said bracket comprising:

A. a base element comprising two arms, each having a length corresponding approximately to the outer dimension of said channel which includes the thickness of said sidewall slabs, said arms being spaced from and parallel to each other, with the adjacent ends of said two arms being rigidly fixed to each other by a crosspiece and having a configuration which provides a groove between said crosspiece and said arm at the end position thereof; and B. a vertical element comprising a horizontal base with two vertical arms rising vertically at a 90° angle with said base, with the lower ends of said arms rigidly fixed to said base, said two vertical arms being spaced from and parallel to each other, and two cross-pieces rigidly fixed to and flat against said vertical arms and at the ends thereof; said base having two parallel edges so spaced from each other and of a size that will fit in the said grooves of said base element whereby upon said base edges being fitted into said grooves, one or two of said vertical elements will be supported vertically in such a manner that said slabs may be supported vertically thereon.

2. The bracket of claim 1, in which said arms of said base element and said vertical element are constructed of angle irons.

3. The bracket of claim 2, in which said grooves are formed between a first side of said angle iron by a rod spaced from and parallel to said first side and rigidly fixed to the inside of said second side of said angle iron.

* * * * *

UNITED STATES PATENT AND TRADEMARK OFFICE

CERTIFICATE OF CORRECTION

PATENT NO. : 4,377,925

DATED : March 29, 1983

INVENTOR(S) : Robert A. Hoover

It is certified that error appears in the above—identified patent and that said Letters Patent is hereby corrected as shown below:

Col. 2, line 24, before "position" insert "engaging".

Signed and Sealed this

*Seventh* Day of *June 1983*

[SEAL]

*Attest:*

DONALD J. QUIGG

*Attesting Officer*

*Acting Commissioner of Patents and Trademarks*